US005127243A

United States Patent [19]

Babuin et al.

[11] Patent Number: 5,127,243

[45] Date of Patent: Jul. 7, 1992

[54] AUTOMATIC LAUNDRY WASHER OF THE ROTATING DRUM TYPE

[75] Inventors: Piero Babuin, Pordenone; Silvano Cimetta, Treviso; Fernando Russo, Pordenone, all of Italy

[73] Assignee: Industrie Zanussi S.p.A., Pordenone, Italy

[21] Appl. No.: 646,551

[22] Filed: Jan. 30, 1991

[51] Int. Cl.[5] ..... D06F 33/02

[52] U.S. Cl. ..... 68/12.05; 68/12.14; 68/12.27

[58] Field of Search ..... 68/12.05, 12.14, 12.27

[56] References Cited

U.S. PATENT DOCUMENTS

| | | | |
|---|---|---|---|
| 3,043,125 | 7/1962 | Horecky | 68/12.14 |
| 3,111,017 | 11/1963 | Searle | 68/12.05 |
| 3,246,491 | 4/1966 | Buss | 68/12.05 |
| 4,733,547 | 3/1988 | Honda | 68/12.05 |

FOREIGN PATENT DOCUMENTS

| | | | |
|---|---|---|---|
| 0057879 | 12/1985 | Japan | 68/12.14 |
| 0121098 | 5/1989 | Japan | 68/12.14 |
| 0175888 | 7/1989 | Japan | 68/12.14 |

*Primary Examiner*—Philip R. Coe

*Attorney, Agent, or Firm*—Wenderoth, Lind & Ponack

[57] ABSTRACT

The invention relates to an automatic laundry washer of the type having a laundering tub in which a drum is rotated by an electric motor at a low speed during a laundering phase, and at a high speed during at least one certrifuging period. For ensuring a complete discharge of foam and lye in the course of a centrifuging period, a pressure switch is adapted to interrupt the rotation of the drum during the centrifuging period and to disconnect the power supply to the program control unit in response to the level within the laundering tub exceeding a predetermined value.

15 Claims, 4 Drawing Sheets

AUTOMATIC LAUNDRY WASHER OF THE ROTATING DRUM TYPE

BACKGROUND OF THE INVENTION

The present invention relates to an automatic laundry washer operable to perform laundering phases and centrifuging by means of a rotatable drum containing the laundry. In Italian Patent No. 1187301, filed on Nov. 27, 1985 in the name of the present applicant, there is described a laundry washer operable to recirculate the lye collected in a receptacle at the bottom of the laundering tub, thereby returning the lye to the rotating drum so as to soak the laundry contained therein. In the course of the execution of the laundering cycle, the drum is adapted to be rotated at the centrifuging speed for short periodic intervals, in order to extract from the laundry a sufficient amount of the lye as required for the operation of the lye recirculation pump.

During these periodic centrifuging intervals, the laundering tub contains not only water, but also detergent, by contrast to what happens during the conventional final spin-drying phase.

When these periodic centrifuging intervals exceed a certain duration of, for instance, three seconds, the centrifuging operation may cause the formation of an excessive amount of foam in the laundering tub, which may then escape from the machine, for instance, by way of the detergent distributor.

The invention described in the above cited patent conveys the teaching of eliminating the disadvantageous formation of an excessive amount of foam by the use of a novel level sensor or pressure switch and an associated circuit for deenergizing the electric motor rotating the drum to thereby interrupt the centrifuging period in response to lye and foam rising above a predetermined level in the course of the centrifuging period. As a result, the high-speed rotation of the drum occurring for determined periods in the course of a laundering phase comes to a halt as soon as the pressure within the laundering tub attains a determined limit value in response to a combination of parameters contributing to the formation of foam, which include, in particular, the dynamic pressure acting on the pressure switch as a result of the increased centrifuging speed of the rotating drum.

This laundry washer has been found to be particularly advantageous, since it permits a considerable savings of water, detergents and electric energy to be achieved.

This laundry washer nevertheless still has a shortcoming which is noted not during the periodic centrifuging phases for the alimentation of the recirculating pump, but rather during the centrifuging phases and simultaneous discharge phases for discharging the liquid from the tub. When the novel pressure switch acts to stop the rotation of the drum in the course of one of these phases, the program control unit continues to run for controlling the selected cycle in the normal manner, so that the discharge pump is stopped after a certain time.

During this normally very short interval there is not enough time for the pump to completely discharge all of the lye and foam remaining in the tub, so that these substances are then dissolved in the water of the subsequently charged rinsing bath.

The disadvantageous effects of foam and lye remaining in the laundering tub also come about even in the case of normal operation of the discharge pump during the discharge phase, when there are external obstacles to the normal liquid flow due, for instance, to an excessive length and/or installation height of the discharge hose, to a strong throttling effect thereof, to the discharge filter being obstructed, or to the fact that the mains voltage is insufficient for properly energizing the discharge pump, so that it is incapable of completely draining the laundering tub.

SUMMARY OF THE INVENTION

It would therefore be desirable, and is in fact an object of the present invention, to provide an automatic laundry washer of the rotating drum type operable to execute laundry centrifuging phases in the course of the laundering cycle without causing an excessive formation of foam, and to fully and completely empty the laundering tub prior to the initiation of subsequent phases of the cycle, even in the case of anomalies in the operation of the laundry washer.

This object is attained according to the invention by a laundry washer of the type defined above, comprising control means operable to determine the pressure within the laundering tub and to interrupt the centrifuging operation in response to this pressure exceeding a predetermined value.

The laundry washer according to the invention is generally characterized by comprising additional control means cooperating with an additional pressure switch for interrupting the power supply both to the program control unit and to the motor employed for rotating the drum, in response to the pressure exceeding the predetermined maximum value.

BRIEF DESCRIPTION OF THE DRAWINGS

The characteristics and advantages of the invention will become more clearly evident from the following description, given by way of a non-limiting example with reference to the accompanying drawings, wherein.

DETAILED DESCRIPTION OF THE PREFERRED EMBODIMENTS

Figure 1:
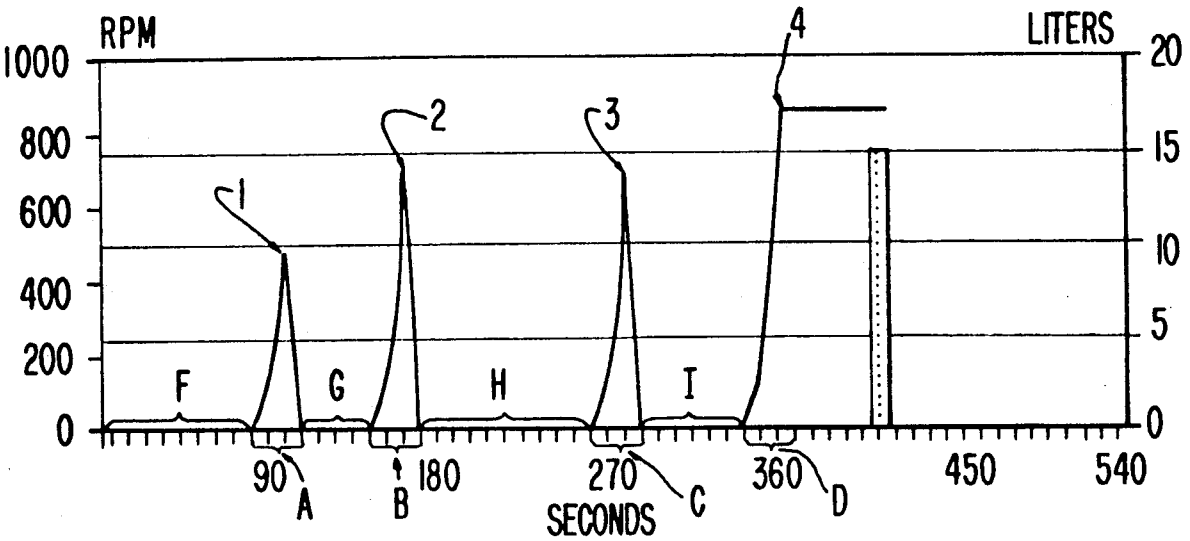
FIG. 1 is a timing diagram of the operation of a motor used for rotating the drum in a laundry washer according to the invention, in the first discharge phase after the laundering phase, and under conditions of reduced efficiency of the discharge components.

The construction of the mechanical and hydraulic components of the laundry washer according to the invention is of a per se known type, for instance as described in the above-mentioned Pat. No. 1187301, and is therefore not shown for the sake of simplicity. The functional characteristics of the laundry washer are likewise generally known.

The present invention is specifically applicable to the laundering tub emptying operation, particularly at the time between two successive phases of a laundering cycle.

During one of these discharge phases the foam produced by the high-speed rotation of the drum is limited to a predetermined level L1 in the tub by the action of a pressure switch 11 operable to terminate the centrifuging phase by interrupting the power supply to the motor rotating the drum when the pressure in the tub attains a corresponding value.

Subsequent to such a termination of the centrifuging phase, the operation of the discharge pump continues for a short period, during which rapid changes of the liquid level and the pressure within the tub give rise to a rapid sequence of high-speed rotation pulses of the drum.

At the end of this period as measured by the timer, the laundering cycle proceeds in the normal manner as determined by the characteristics of the program control unit and the electric circuit.

The actually employed programs provide that the operating time of the discharge pump is sufficient for completely emptying the laundering tub when the conditions of the charge, of the laundry washer in general and of the power supply are in a normal state, which is not, however, always the case, as indicated above.

It is evident that the foam is not completely exhausted and discharged due to its consistency, which causes it to settle rather slowly and to collect at the bottom of the tub.

In addition it is to be observed that the foam still contained in the laundry is retained therein, because even a sequence of short high-speed rotation periods, as described for instance in the above-mentioned Italian patent or in German Patent Application DE 3638495, will not always ensure that the laundering cycle is continued in the normal manner only after all of the foam has been discharged from the bottom of the tub, and also from the laundry.

It can thus be generally stated that the presently known laundering cycles provide that the centrifuging phase is carried out in an intermittent manner under the control of the pressure switch, and is therefore dependent on the level of the lye contained in the tub.

In any case the centrifuging phase has been terminated in response to a specific signal supplied by the program control unit independently of the amount of foam still contained in the tub.

According to the invention, and by way of contrast with the prior art, there is provided a second level L2 for the control not only of the operation of the motor 7 for the high-speed rotation of the drum, but also of the operation of the motor 6 which controls the advance of the program control unit.

By suitable calibration and positioning of pressure switch 4 this second level L2 is adjusted to be substantially lower than the first level L1, to which the above-described pressure switch 11 is responsive, and lies preferably below the bottom end of the tub, so that, when the liquid in the tube is higher than the second level L2, the pressure switch 4 acts to interrupt the high-speed rotation and the advance of the program control unit, while only the discharge pump remains in operation for a sufficient time to lower the liquid in the tub to below the second level L2. At this instant the pressure switch 4 acts to reinstate the power supply to the motor for high-speed rotation of the drum and to the program control unit, which results in the further appearance of liquid and foam, and a corresponding rise of the liquid level and the pressure.

This causes the pressure switch 4 to act again in the above described manner, so that the described operations are cyclically repeated.

It is evident that the level to which the pressure switch 4 is responsive can be adjusted in such a way that the discharge pump is enabled to completely discharge all of the liquid contained in the tub in a short time, because the operation of the pump is not interrupted by the program control unit.

Figure 2:
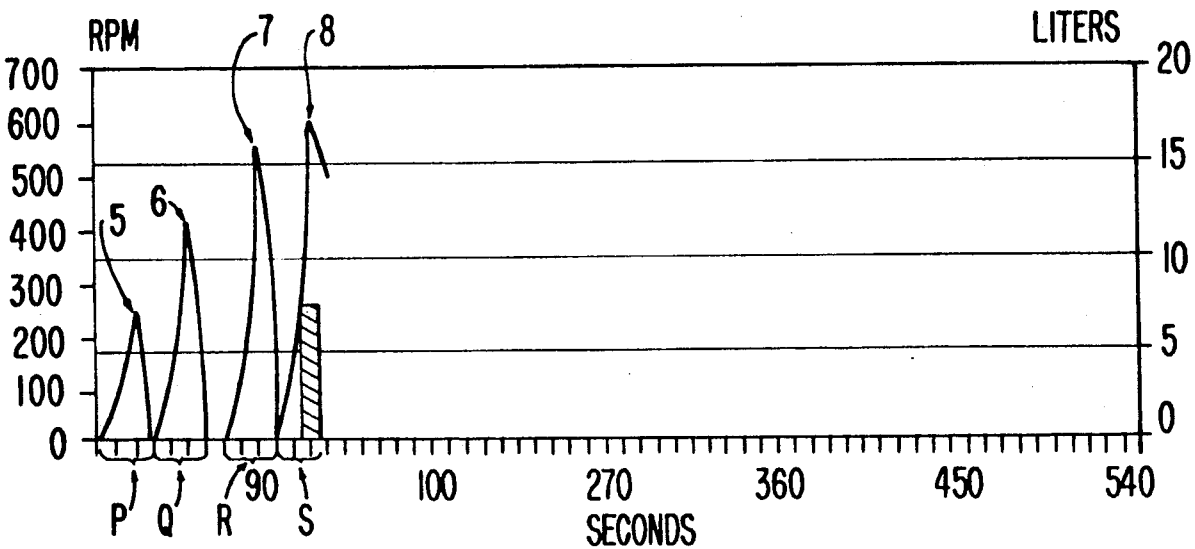
FIG. 2 is a timing diagram showing the operation of a similar laundry washer, under the same conditions as above, but without the provisions of the inventions.
Figure 4:
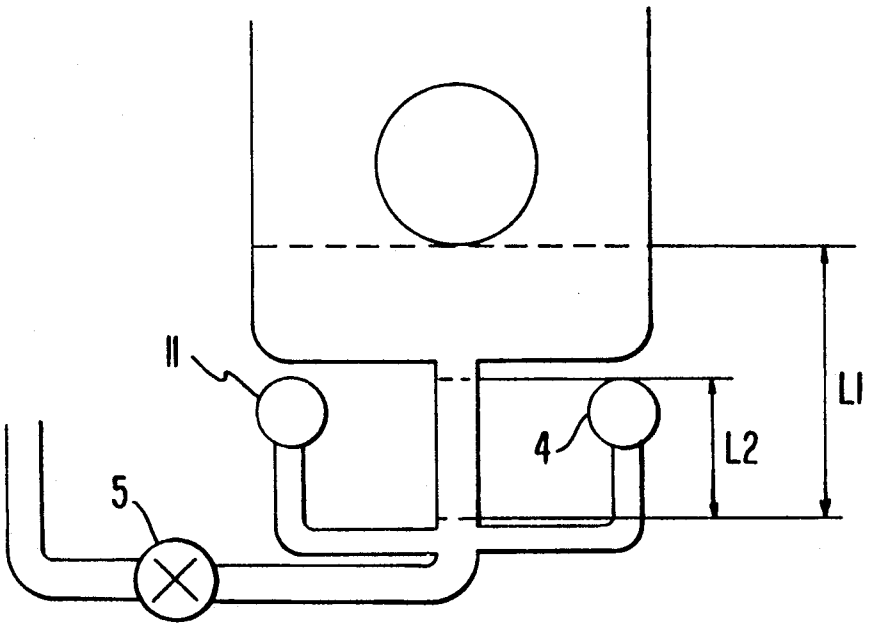
FIG. 4 is a schematic diagram of determined critical levels and the arrangement of pressure switches in the laundry washer according to the invention.

It is also evident that this sequence of cyclical operations can be terminated at a determined instant; this instant can be determined in various manners, for instance after a certain number of high speed rotation and discharge phases, or after the high-speed rotation has been going on for a certain time without intervention by the pressure switch 4. Shown in FIG. 2 is a laboratory test recording of the operating characteristics of a typical domestic laundry washer without the application of the present invention, during the centrifuging and discharge phase under conditions of an excessive amount of detergent or of hampered discharge operation.

Indicated on the lefthand ordinate of the diagram is the rotational speed of the drum as a function of the time from the start of the discharge operation, while on the righthand ordinate there is indicated the total liquid volume (in liters) discharged at the end of the discharge phase.

It is noted that the drum is rotated in successive pulses (P, Q, R, S) practically without any interval between one pulse and the next (the bases of the pulses are in fact contiguous). The overall time spent for the centrifuging operations substantially corresponds to the time measured by the program control unit due to the latter's continuous operation. In the example under consideration, this time continues tot he instant at which the fourth pulse S is interrupted, i.e. 120 seconds.

In the course of this period, the pressure switch 11 operates four times, at the instances designated 5, 6, 7 and 8. At each of these instances the actuation of the drum is interrupted and again reinstated immediately thereafter by the subsequent reset pulse of the pressure switch 11.

FIG. 1 illustrates the results of exactly the same kind of a test as described above, with the same laundry washer, under the same conditions, and in the same charging state.

Figure 3:
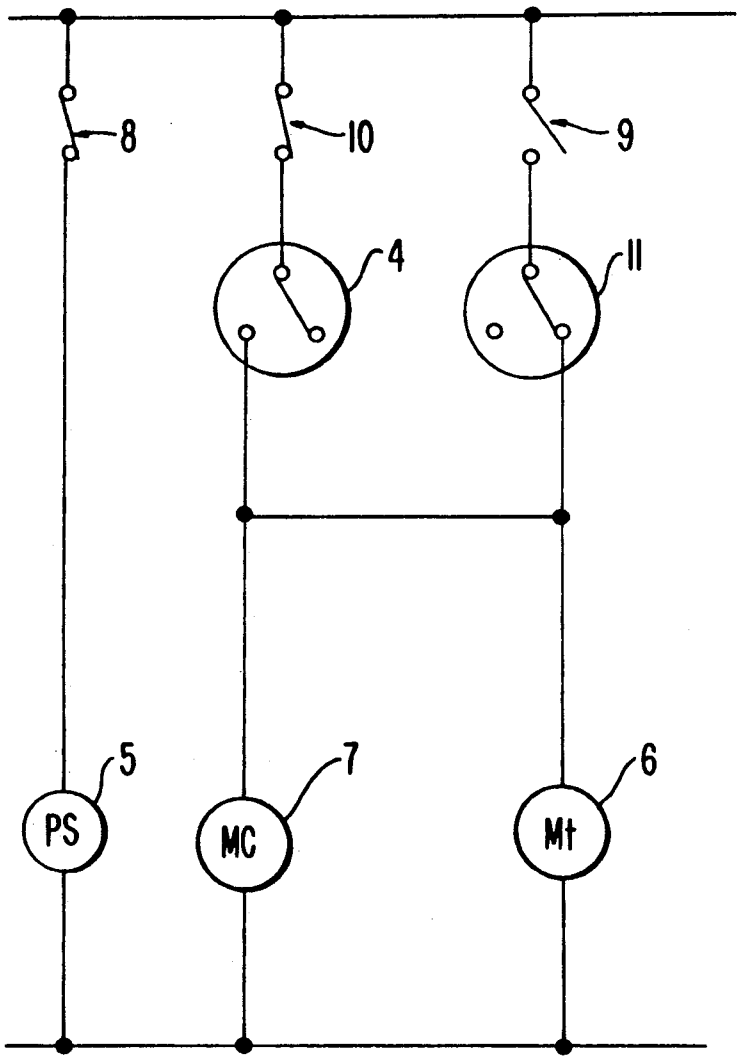
FIG. 3 is a circuit diagram of a preferred embodiment of a control circuit for the program control unit of the laundry washer according to the invention.

The only difference consists in that the present invention has been applied, in accordance, for example, with the diagram of FIG. 3.

The difference between the results shown in FIGS. 1 and 2 is fully evident, and its significance readily understandable to one skilled in the art, so that a more detailed explanation is scarcely required. It shall merely be pointed out that the intervals F, G, H and I between one pulse and the next one are representative of periods during which the discharge pump continues to operate while the high-speed rotation of the drum and the operation of the program control unit are interrupted, and that the overall duration of pulses A, B, C and D is equal to the overall duration of pulses P, Q, R and S in FIG. 2, because in both cases the high-speed rotation pulses are determined in response to the actual lowering of the liquid contained in the laundering tub to below the second level L2.

The result of all this is evident from the respective graphs, showing the discharged liquid volumes to amount to 15 liters in the case of FIG. 1, and to about half this volume in the case of FIG. 2.

The invention thus provides in fact a laundry washer capable of automatically controlling the operating time of the discharge pump as a function of the amount of liquid actually contained in the laundering tub, and does thereby solve the problems arising from too short of discharge periods with the resultant remaining of lye in the tub, and the inverse problem of excessively long discharge periods rigidly determined by the program control unit, resulting in useless prolongation of the operating cycle and premature wear of the motor rotating the drum and of the machine as a whole due to the unnecessary prolongation of the high-speed rotation periods.

FIG. 3 shows only certain functional and control elements required for the understanding of the present invention.

The laundry washer comprises a program control unit having a motor indicated at 6 and including, for instance, a timer with a number of cam discs adapted to rotate at different speeds for actuating respective electric contacts to control the combined operations of the various functional components.

Prior to the initiation of a discharge phase following a laundering phase, pressure switch 11, which is also used as the foam-suppressing switch according to Italian Patent No. 1187301, is in the operative state shown in FIG. 3, because the level of foam and lye in the laundering tub lies above the predetermined level L2. At this time the switch 8 connecting the power supply to the discharge pump 5 is open, and the switch 10 is closed, whereas the supplementary pressure switch 4 controlling the discharge operation is open, because the level L1 is considerably above the level L2 to which the pressure switch is responsive.

For initiation of the discharge phase, the timer motor 6 acts to close switch 8, causing discharge pump 5 to be continuously energized, to open switch 9 so as to interrupt the power supply to drum motor 7 and timer motor 6, and to close switch 10 in preparation of the resumption of the power supply to motors 6 and 7 via pressure switch 4.

After discharge pump 5 has discharged a sufficient amount of liquid for lowering the liquid to level L2, pressure switch 4 operates to close the power supply circuit to motors 6 and 7 in cooperation with the already closed switch 10, causing motors 6 and 7 to rotate the drum and to advance the timer, respectively, until the high-speed rotation of the drum causes the liquid level to again rise above L2, whereupon pressure switch 4 again acts to interrupt the power supply to motors 6 and 7.

These steps are repeated until the overall activation time of timer motor 6 equals the rated activation time of the timer. At this instant the timer is advanced by a step so as to resume the controi of the subsequent phases of the programmed cycle.

The described laundry washer may obviously modified in various manners within the purview of the invention.

Motor 7 may, for instance, be of any type suitable for the given purpose, and the program control unit may be different from what has been described. The high-speed rotation period, or periods, may be interposed at any time during the operating cycle of the machine under the control of the program control unit.

An additional advantage of the invention consists in that it is possible to timely and automatically inform the user of the progress of the discharge operation, based on the intervals between successive centrifuging phases in the course of a discharge operation.

It is in fact evident that, when there is any malfunction or obstacle preventing the discharge system from efficiently discharging the liquid from the tub, e.g. a clogged filter, obstructed discharge hose or any of the other reasons discussed above, the automatic result is a corresponding prolongation of the time required for the discharge operation. And since according to the invention the discharge time includes the intervals between successive centrifuging phases, the observation of these times permits any irregular function of the discharge system to be immediately detected.

A useful improvement of the present invention is therefore the provision of a system capable of automatically monitoring the discharge intervals between successive centrifuging pulses and of comparing the thus detected intervals to predetermined reference intervals.

Laboratory tests carried out under widely different conditions simulating various causes for the reduction of the efficiency of the discharge system have shown, that amongst the numerous possibilities of comparison, the most significant of these comparisons are directed to the first and also to the last intervals between successive centrifuging pulses, for informing the user of the occurrence of problems, and of the kind of a problem, so as to permit him to take timely action.

If in fact the first discharge intervals are unusually long, i.e. longer than a predetermined time T1, this may indicate the existence of difficulties with regard to various components or conditions affecting the discharge operation, or the fact that these components or conditions lie within the norm, and that the prolongation of the discharge intervals is due to abnormal conditions of a temporary nature which are going to disappear in the subsequent phases, for instance the formation of excessive amounts of foam.

The measuring of the first discharge intervals can thus immediately inform the user that "something is wrong", although this information would have to be confirmed in the course of subsequent discharge phases.

If, finally, of a comparison of the duration of the last discharge interval between centrifuging pulses to a predetermined reference time T2, which may be equal to or shorter than the first reference time T1, indicate the persistence of an abnormal condition, the previously given warning is confirmed to inform the user of a real and permanent cause.

The techniques of measuring variable time intervals and comparing them to fixed reference times, and of the generation of a signal indicative of the result of such comparison are generally known in the art and need not be explained.

Figure 5:
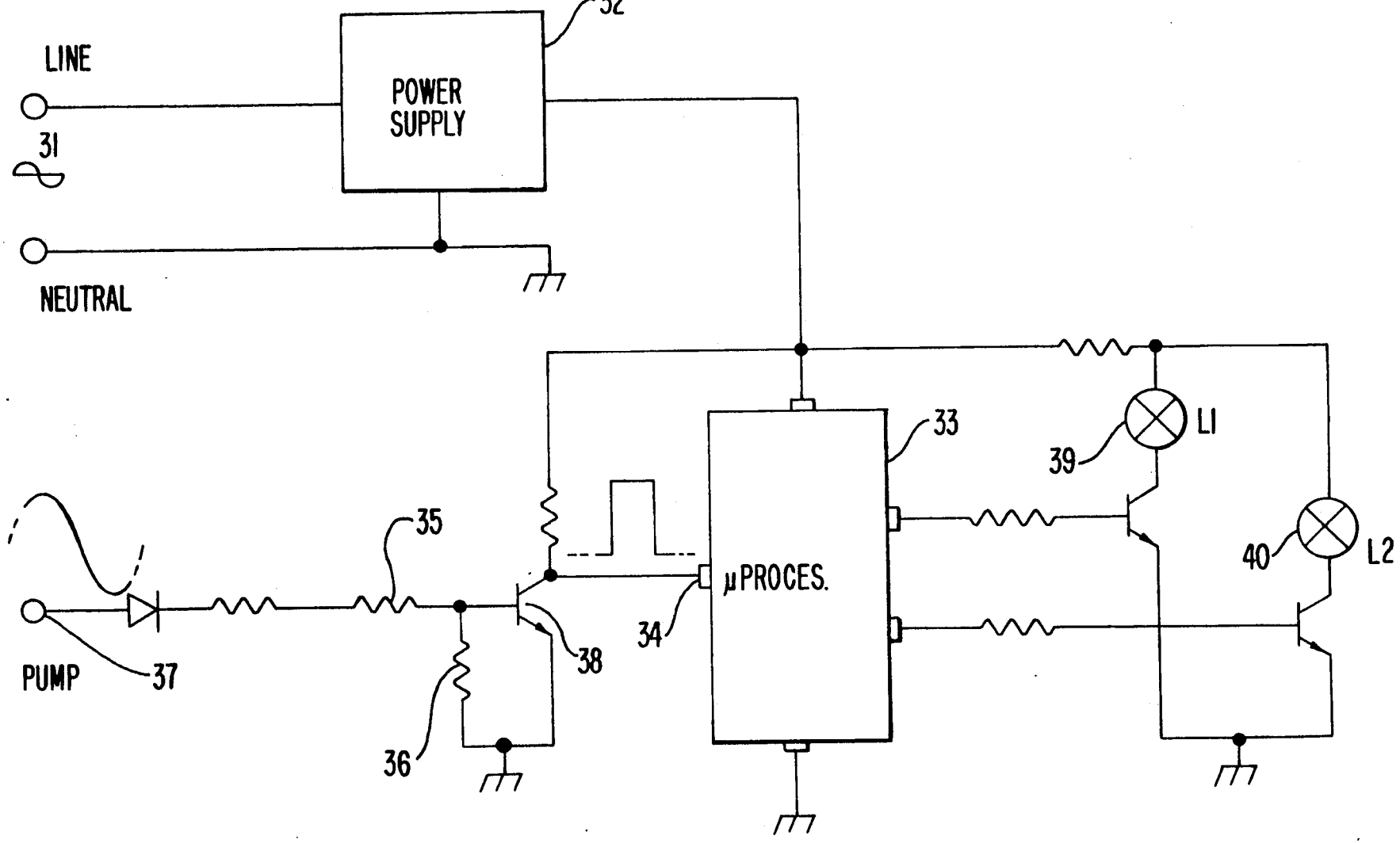
FIG. 5 is a block diagram of an electronic circuit in an improved modification.

What has been explained above with reference to the automatic indication of abnormal operating conditions during discharge phases can be realized in a particularly efficient manner by means of integrated electronic circuits as shown by way of example in FIG. 5.

In this figure, reference numeral 31 indicates an electric mains power supply, 32 a rectifier or DC power supply, 33 a single-chip ROM microprocessor, 35 and 36 voltage attenuation and tuning resistors, 37 a terminal for detecting the operating voltage of the discharge pump, 38 a chopper for converting this voltage to a square waveform, L1 and L2 two lamps or external signalling devices, and 39 and 40 two amplifiers for energizing devices L1 and L2, respectively.

The illustrated circuit functions in the following manner. The voltage supplied to the discharge pump 5 is detected at terminal 37 and applied to the input of chopper 38 operating to convert it to a square waveform signal of reduced voltage, which is then applied to input 34 of microprocessor 33. The latter detects the start of the pulsed signals oscillating at the mains frequency and starts to count the time from the instant of activation of the discharge pump.

Depending on the program stored in microprocessor 33, and as a function of the counted time, the microprocessor activates and deactivates the two amplifiers 39 and 40, so that the associated external signalling devices L1 and L2 are correspondingly activated and deactivated.

Figure 6:
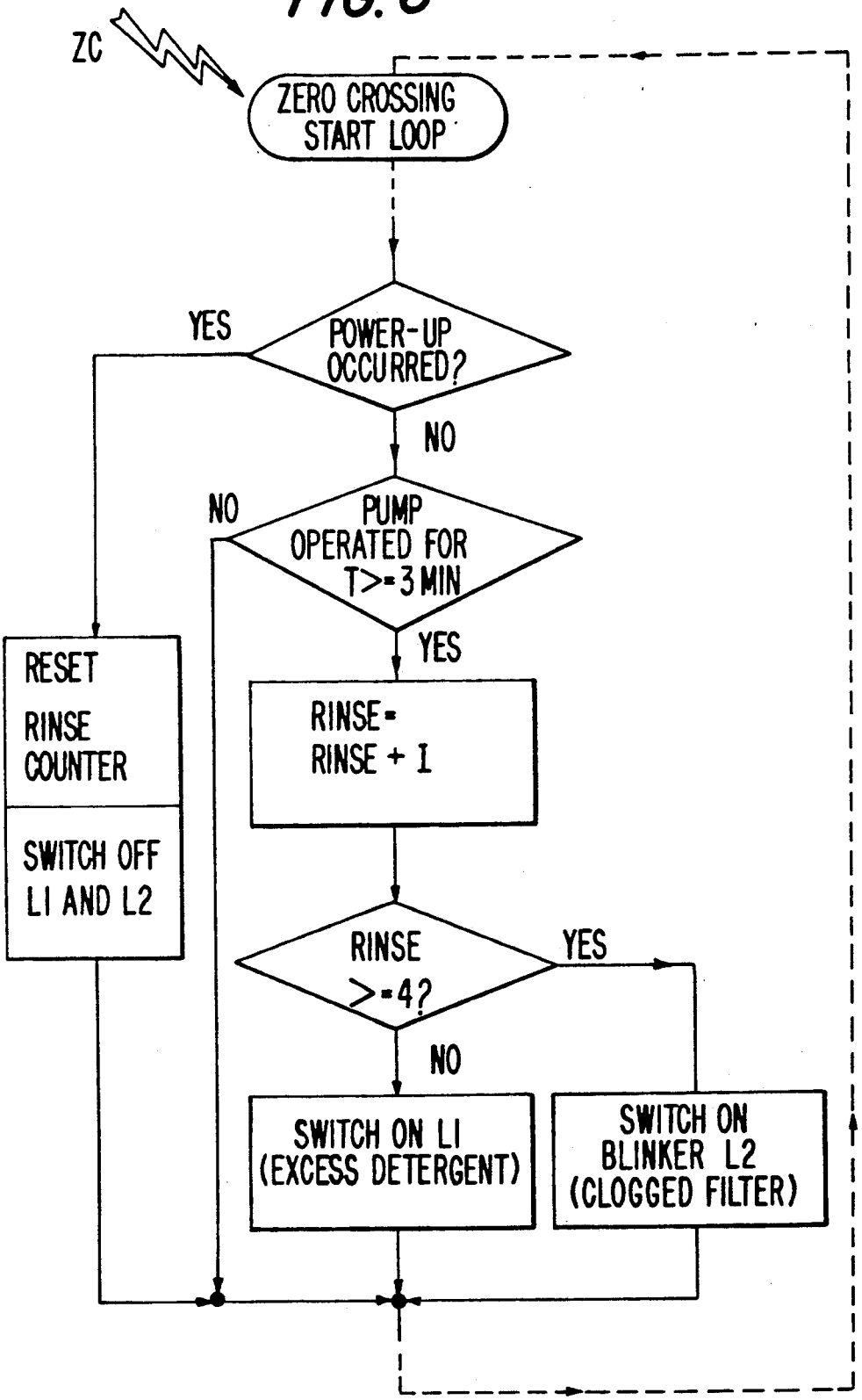
FIG. 6 is a flow chart of the control operation performed by the circuit illustrated in FIG. 5.

The operation of microprocessor 33 is illustrated in FIG. 6, wherein "Zero crossing start loop" represents the operation of a timer functioning at the mains frequency of 50 Hz.

In this manner, every 20 ms the logic flow proceeds from "Zero crossing start loop" to ascertain whether the machine is disconnected from the electric mains supply, in which case L1 and L2 are deactivated and all of the other program variables are reset.

As long as there has not been a "Power-up", and the machine has not previously been switched on, the program ensures that the pump is not activated.

In the case that the pump has been activated, a counter "Pump activated" is started, and when a pre-set time of, for instance, 3 minutes has been counted, the program proceeds to compare any given rinsing step to the final rinsing operation, in the present example the fourth such operation as indicated by the symbol 4 in the last box in FIG. 6.

When the duration of any rinsing operation save the fourth and last exceeds the maximum time T1 of three minutes, signalling device L1 is activated. And when the fourth and last rinsing operation exceeds this time, signalling device L2 is activated, preferably in an intermittent manner.

The activations of devices L1 and L2 are mutually exclusive.

The signals provided by device L1 (excessive amount of detergent) and by device L2 (for example, clogged filter) only disappear when the user stops the operation of the machine. This is accomplished by means of the first circuit "se" shown in FIG. 7.

It is evident that the above description has merely been given by way of example, and that the present invention encompasses any alterations and modifications which the skilled artisan will not have any difficulty in devising.

We claim:

1. An automatic laundry washing machine comprising:

a laundering tub having a bottom located at a lowermost portion thereof;

a discharge pipe open to the laundering tub at said bottom thereof;

a drum rotatably supported within said laundering tub;

an electric motor operatively drivingly connected to said drum so as to rotate said drum within the laundering tub;

program control unit means, operatively connected to said electric motor, for controlling said motor to effect the timed execution of at least one laundering operation by the washing machine in which said drum is rotated at a low speed while the tub is filled with washing solution and at least one centrifuging phase in which said drum is rotated at a high speed faster than said low speed; and pressure switch means, operatively connected to said program control unit means and to said electric motor, for sensing the pressure of liquid in the washing machine and for interrupting the operation of said program control unit means contemporaneously with the interruption of the operation of said electric motor during said centrifuging phase whenever the pressure sensed thereby is at all greater than a predetermined value corresponding to the liquid in the washing machine being at a level located below the bottom of said laundering tub within said discharge pipe.

2. An automatic laundry washing machine as claimed in claim 1, wherein said program control unit means includes a motor and a normally closed switch provided to connect said program control unit means to a power source, and said pressure switch means comprises a pressure-operated switch electrically connected in series with said normally closed switch and the motor of said program control unit means, said pressure-operated switch opening in response to when the pressure of the liquid in the washing machine corresponds to a value greater than said predetermined value.

3. An automatic laundry washing machine as claimed in claim 1, and further comprising discharge pump means operatively connected to said discharge pipe for pumping liquid from said tub through said pipe, wherein said program control unit means is operatively connected to said discharge pump means for controlling said pump means to effect a discharge operation in which the pump means pumps liquid from the tub, wherein said program control unit means controls said electric motor to effect said centrifuging phase over the course of said discharge operation such that discharge intervals will occur between successive times at which the operation of said electric motor is interrupted and reinstated by said pressure switch means, and further comprising automatic time measuring and comparing means for measuring the duration of at least one of said discharge intervals, for comparing each said at least one of said discharge intervals as measured with a stored time period, and for generating at least one externally perceivable signal in response to each said at least one of said intervals as measured exceeding the stored time period to which it is compared.

4. An automatic laundry washing machine as claimed in claim 3, wherein said at least one discharge interval includes a first discharge interval occurring during said discharging operation such that said automatic time measuring and comparing means operates to generate a said externally perceivable signal when said first discharge interval exceeds the stored time period to which it is compared, and said automatic time measuring and comparing means operates to cancel said signal when a subsequently occurringly discharge interval is shorter than the stored time period to which it is compared.

5. An automatic laundry washing machine as claimed in claim 4, wherein said automatic time measuring and comparing means operates to cancel said signal only when the subsequently occurring discharge interval is shorter than the stored time period to which it is compared, irrespective of characteristics of the others of said discharge intervals.

6. An automatic laundry washing machine as claimed in claim 3, wherein said at least one discharge interval includes a first discharge interval occurring during said discharging operation such that said automatic time measuring and comparing means operates to generate a said externally perceivable signal when said first discharge interval exceeds the stored time period to which it is compared, and said automatic time measuring and comparing means operates to generate a second said externally perceivable signal when at least one of the discharge intervals occurring subsequently to said first discharge interval is longer than the stored time period to which it is compared.

7. An automatic laundry washing machine as claimed in claim 6, wherein said automatic time measuring and storing means modifies the first externally perceivable signal to generate the second externally perceivable signal.

8. An automatic laundry washing machine as claimed in claim 3, wherein said automatic time measuring and storing means includes chopper means for converting voltage to a square waveform, terminal means operatively associated with said discharge pump means and operatively electronically connected to said chopper means for inputting voltage which operates said discharge pump means to said chopper means, voltage attenuation means operatively electronically connected between said terminal means and said chopper means for reducing the voltage input to the chopper means whereby the chopper means converts the reduced voltage to a square waveform, RAM microprocessor means operatively electronically connected to said chopper means for processing the square waveform of the voltage converted by said chopper means, amplifiers operatively electronically connected to said RAM microprocessor means so as to receive processed signals therefrom, and external signal generating means operatively electrically associated with said amplifiers for producing said externally perceivable signals upon activation of said amplifiers by said RAM microprocessor means.

9. An automatic laundry washing machine comprising:

a laundering tub;

discharge pump means operatively connected to said laundering tub for pumping liquid from said tub;

a drum rotatably supported within said laundering tub;

an electric motor operatively drivingly connected to said drum so as to rotate said drum within the laundering tub;

program control unit means, operatively connected to said electric motor, for controlling said motor to effect the timed execution of at least one laundering operation by the washing machine in which said drum is rotated at a low speed while the tub is filled with washing solution and at least one centrifuging phase in which said drum is rotated at a high speed faster than said low speed;

pressure switch means, operatively connected to said program control unit means and said electric motor, for sensing the pressure of liquid in the washing machine and for interrupting the operation of said program control unit means contemporaneously with the interruption of the operation of said electric motor during said centrifuging phase;

said program control unit also being operatively connected to said discharge pump means for controlling said pump means to effect a discharge operation in which the pump means pumps liquid from the tub, wherein said program control unit means controls said electric motor to effect said centrifuging phase over the course of said discharge operation such that discharge intervals will occur between successive times at which the operation of said electric motor is interrupted and reinstated by said pressure switch means; and further comprising automatic time measuring and comparing means for measuring the duration of at least one of said discharge intervals, for comparing each said at least one of the discharge intervals as measured with a stored time period, and for generating at least one externally perceivable signal in response to each said at least one of said intervals as measured exceeding the stored time period to which it is compared.

10. An automatic laundry washing machine as claimed in claim 9, wherein said program control unit means includes a motor and a normally closed switch provided to connect said program control unit means to a power source, and said pressure switch means comprises a pressure-operated switch electrically connected in series with said normally closed switch and the motor of said program control unit means, said pressure-operated switch opening in response to when the pressure of the liquid in the washing machine corresponds to a value greater than said predetermined value.

11. An automatic laundry washing machine as claimed in claim 9, wherein said at least one discharge interval includes a first discharge interval occurring during said discharging operation such that said automatic time measuring and comparing means operates to generate a said externally perceivable signal when said first discharge interval exceeds the stored time period to which it is compared, and said automatic time measuring and comparing means operates to cancel said signal when a subsequently occurringly discharge interval is shorter than the stored time period to which it is compared.

12. An automatic laundry washing machine as claimed in claim 11, wherein said automatic time measuring and comparing means operates to cancel said signal only when the subsequently occurring discharge interval is shorter than the stored time period to which it is compared, irrespective of characteristics of the others of said discharge intervals.

13. An automatic laundry washing machine as claimed in claim 9, wherein said at least one discharge interval includes a first discharge interval occurring during said discharging operation such that said automatic time measuring and comparing means operates to generate a said externally perceivable signal when said first discharge interval exceeds the stored time period to which it is compared, and said automatic time measuring and comparing means operates to generate a second said externally perceivable signal when at least one of the discharge intervals occurring subsequently to said first discharge interval is longer than the stored time period to which it is compared.

14. An automatic laundry washing machine as claimed in claim 13, wherein said automatic time measuring and storing means modifies the first externally perceivable signal to generate the second externally perceivable signal.

15. An automatic laundry washing machine as claimed in claim 9, wherein said automatic time measuring and storing means includes chopper means for converting voltage to a square waveform, terminal means operatively associated with said discharge pump means and operatively electronically connected to said chopper means for inputting voltage which operates said discharge pump means to said chopper means, voltage attenuation means operatively electronically connected between said terminal means and said chopper means for reducing the voltage input to the chopper means whereby the chopper means converts the reduced voltage to a square waveform, RAM microprocessor means opertively electronically connected to said chopper means for processing the square waveform of the voltage converted by said chopper means, amplifiers operatively electronically connected to said RAM microprocessor means so as to receive processed signals therefrom, and external signal generating means operatively electrically associated with said amplifiers for producing said externally perceivable signals upon activation of said amplifiers by said RAM microprocessor means.

* * * * *